United States Patent [19]

Matsuura

[11] Patent Number: 4,884,428

[45] Date of Patent: Dec. 5, 1989

[54] SPRING PRODUCING APPARATUS

[76] Inventor: Norio Matsuura, 6-10-16, Mino-o, Mino-o-shi, Osaka 562, Japan

[21] Appl. No.: 186,088

[22] Filed: Apr. 25, 1988

[51] Int. Cl.[4] ..... B21F 3/04

[52] U.S. Cl. ..... 72/142; 29/173

[58] Field of Search ..... 29/173; 72/142, 143, 72/144

[56] References Cited

U.S. PATENT DOCUMENTS

| | | | |
|---|---|---|---|
| 2,811,193 | 10/1957 | Iversen | 72/144 |
| 3,031,006 | 4/1962 | Fokkinga | 72/144 |
| 3,186,820 | 6/1965 | Adkins | 72/144 |
| 4,084,420 | 4/1978 | Tsutsumino | 72/144 |
| 4,616,682 | 10/1986 | Groenewegen | 72/144 |
| 4,715,202 | 12/1987 | Shibata et al. | 72/143 |

*Primary Examiner*—P. W. Echols

*Attorney, Agent, or Firm*—George B. Oujevolk

[57] ABSTRACT

The present invention relates to a spring producing apparatus which is constituted such that a drive roller (2) is connected to a controlled speed motor (13) with a clutch brake via a suitable transmission mechanism while a bending die (7) and a pitch tool (10) are connected to adjusting actuators (16) and (22) by way of cams (17) and (23), respectively, and a cutter (11) is connected to a cutting actuator, whereby operations of the motor (13) and the actuators (16) and (22) are set and controlled suitably by a controller. The present invention further relates to a spring producing apparatus which comprises a chuck (100) connected to a reversible motor with a clutch brake by way of a transmission mechanism, a metal core (101) fittably and removably mounted on the chuck (100), a pitch tool/guide member (117) mounted on a linear guide (110) which is moved in a parallel relationship to the metal core on the chuck, a wire stock (103) which is fed through a nozzle (120) of the pitch tool/guide member (117) being fitted into and arrested by the chuck (100) whereafter the wire stock (103) is wrapped into coils around the metal core (101), an actuator (126) disposed on the linear guide (110) for movement together with the pitch tool/-guide member (117) so as to be pushed against or pulled by the guide (117) to apply a predetermined pitch to the coils, and a cutter (152) which is moved up and down by operation of a cutting actuator (153) after releasing of the push or pull at the actuator (126).

1 Claim, 5 Drawing Sheets

SPRING PRODUCING APPARATUS

BACKGROUND OF THE INVENTION

1. Field of the Invention

This invention relates to improvements in or relating to a spring producing technique which is constituted such that a wire stock is fed intermittently by a pair of wire stock feeding rollers consisting of a drive roller and a follower roller and is pressed against and bent by a deflecting face of an opposing bending die whereafter it is wrapped into coils around a metal core while a predetermined pitch is being applied to the wire stock by means of a pitch tool and is finally cut by a cutter, and more particularly to a spring producing apparatus which is designed such that the developing length, the configuration of a pitch and so on can be changed suitably in producing a spring.

Further, the second invention relates to a spring producing apparatus wherein, in producing a coil spring or in experimentally producing a coil spring, feeding of a wire stock or the profile of a pitch can be suitably changed by a simple mechanism and the spring producing apparatus can be utilized also as an experimental coil spring producing apparatus.

2. Prior Art

Generally, pneumatically controlled automatic spring producing machines and automatic spring coiling machines are well known. However, since such machines are very expensive, they lead to a high cost unless they are applied for mass-production. Thus, it is a drawback of such machines that they are not suited for production of a large number of products in a small quantity.

Particularly, it is quite impossible to utilize a large-size spring machine as an experimentally producing machine.

Known as a spring machine which can be replaced by such a large-size spring machine is a spring producing apparatus 30 shown in FIG. 8.

The spring producing apparatus 30 of the type mentioned includes a crank device 32, a connecting rod 33 and a sector gear 35 connected in this order to a main shaft 31 which is being continuously rotated in one direction by a motor not shown. Accordingly, the sector gear 35 is rocked reciprocally around a shaft 36, and the rocking motion of the sector gear 35 is taken out as rotation of a drive roller 39 in one direction via a one-way clutch not shown. A follower roller 40 is held in contact with and rotated following the drive roller 39, and a wire stock 42 is held between and fed intermittently by the drive roller 39 and the follower roller 40 toward a bending die 43 until it is pressed against and bent by a deflecting face 43*a* of the bending die 43 whereafter it is wrapped into coils around a metal core 45. The wire stock 42 is then cut to form a spring having a predetermined developing length l by a cutter 46 which is operated in a mechanically synchronized relationship to the rotation of the main shaft 31 when a pair of wire stock feeding rollers 41 consisting of the drive roller 39 and the follower roller 40 are stopped.

In producing a spring in such a manner, determination of a pitch of a spring S to be produced is made in a following manner. In particular, referring to (a) and (b) of FIG. 9, a pitch shaft 52 is slidably displaced in an axial direction thereof via a cam follower 49, a support shaft 50 and a pitch lever 51 by a cam 47 which is secured to and rotated by the aforementioned main shaft 31 until a predetermined portion of the wire stock 42 shaped into coils and wrapped around the metal core 45 (refer to FIG. 8) is pressed in the rightward direction as viewed in (a) of FIG. 9 and in a direction from the top to the bottom as viewed in (b) of FIG. 9 and by a pitch tool 53 securely mounted at an end of the pitch shaft 52.

Meanwhile, adjustment of the coil diameter and the profile of a spring to be produced is attained by adjustment of the position of the deflecting face 43*a* of the bending die 43 relative to the metal core 45 via a cam follower 56, a support shaft 57 and a lever 59 by a further cam 55 which is rotated by the aforementioned main shaft 31 as shown in FIG. 10. More particularly, if a circular cam of a predetermined radius is used which rotates around a shaft so that the position of the bending die 43 may not be changed by the cam 55, a spring to be produced will be an ordinary cylindrical spring of a predetermined coil diameter, but if such a cam is employed that the position of the die 43 is gradually moved away from the metal core 45 by the cam 55, a spring to be produced will present a conical configuration.

By the way, with the conventional spring producing apparatus 30 described above, in order to change the developing length of a spring S to be produced, it is necessary to change, for example, the length of the crank device 32 to change the wire stock feeding rate by the pair of wire stock feeding rollers 41; in order to change the pitch of the spring S, it is necessary to change the cam 47 to vary the moving amount of the pitch tool 53; and in order to change the coil diameter or the profile of a spring S, it is necessary to change the cam 55 to vary the position or the moving amount of the bending die 43. Accordingly, when a type of spring to be produced is to be changed, considerably high skill is required for such a changing operation, and much time is required for preparations. Accordingly, there is a drawback that the spring producing apparatus is not suited for experimental production of several types of coil springs.

In the drawings, reference symbol C denotes connection to a controller not shown.

SUMMARY OF THE INVENTION

It is an object of the present invention to provide a spring producing apparatus which eliminates such problems as described above and wherein, when the type of spring to be produced is to be changed, a changing operation thereof can be performed in a short period of time without requiring special skill.

In order to attain the object of the present invention, a spring producing apparatus is constituted such that a drive roller of a pair of wire stock feeding rollers is connected to a controlled speed motor with a clutch brake via a suitable transmission mechanism while a bending die and a pitch tool are individually connected to adjusting actuators by way of cam means, and a cutter is connected to a cutting actuator, whereby operations of the motor and the actuators are set and controlled suitably by a controller.

By employment of the means described above, if predetermined setting operations are effected utilizing various setting graduations and so on on the controller when the type of spring to be produced is to be changed, the rotational speed of the controller speed motor with the clutch brake is changed in response to such operations while the timings of engagement and disengagement of the clutch brake are changed so that the feeding amount of a wire stock by the wire stock feeding rollers, that is, the developing length of a spring to be produced, is changed while the operation timing of the cutting actuator is changed.

Meanwhile, the positions or the extents of displacement of the individual adjusting actuators are altered, and in response to such alterations, the position or the extent of displacement of the pitch tool or bending die is altered by way of the corresponding cam means so that the pitch, coil diameter or profile of a spring to be produced is changed.

Further, according to the present invention, since the spring producing apparatus is constituted such that the drive roller of the pair of wire stock feeding rollers is connected to the controlled speed motor with the clutch brake via a suitable transmission mechanism while the bending die and the pitch tool are connected to the respective adjusting actuators by way of the respective cam means, and the cutter is connected to the cutting actuator, whereby operations of the motor and the individual actuators are set and controlled suitably by the controller, the spring producing apparatus is designed as of the electrically controlled type, and in changing the type of spring to be produced, an operator will perform only setting changing operations by way of the controller while it is not necessary for the operator to make adjustments upon exchange and/or mounting of mechanical components of the spring producing apparatus. Accordingly, alteration of the type of springs to be produced can be made simply and assuredly within a short period of time without requiring special skill therefor.

Further, since there is no mechanical restriction, the feeding rate of a wire stock, that is, the developing length of a spring, to a fairly high speed as desired.

Besides, since there is no necessity of making preparations of various cams or the like, the expense for the cams or the like and the spacing in which they are to be stored become unnecessary, and the spring producing apparatus can be provided at a low cost.

Subsequently, in accordance with the type of spring to be produced on a spring producing apparatus of the second inventive feature contemplated, a core with a chuck and a pitch tool/guide member are exchanged while the rotational speed of a controlled speed motor with a clutch brake and the extent of push or pull of the pitch tool/guide member are changed, whereby the diameter of a wire stock and the feeding rate of the wire stock, that is, the developing length of a spring to be produced, can be changed readily and the operational timing of the cutting actuator can be changed.

Accordingly, with the apparatus of the second inventive feature contemplated, since a linear guide, a core metal parallel to the linear guide and the pitch tool/-guide member for guiding a wire stock to be fed to the metal core are provided on a table, only by chucking the wire stock passed through a nozzle, a coil spring of the closely contacted type can be produced readily only by operation of the metal core, and accordingly, no skill is required and the operation can be carried out even by an amateur.

Besides, since no special control panel nor control device is required, the machine can be provided at a low cost.

In case the diameter of a wire stock is different, the width between the chuck and the core metal is different so that it is impossible to feed the wire material. Thus, by exchanging the chuck and the core, a spring coil can be produced readily.

Besides, if a control device such as a known sensor is incorporated into the apparatus of the present invention, a machine of a high efficiency can be provided.

The invention as well as other features of the invention will be better understood from the following detailed description and the accompanying drawings, in which:

DETAILED DESCRIPTION OF THE INVENTION

Figure 1:
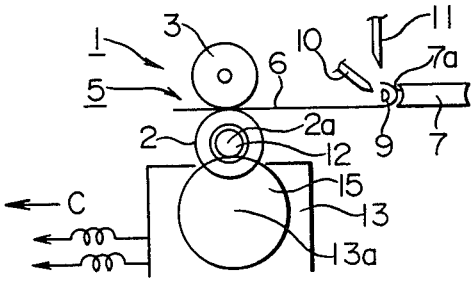
FIG. 1 is a partial front elevational view of an essential part of an embodiment of spring producing apparatus according to the present invention.
Figure 2:
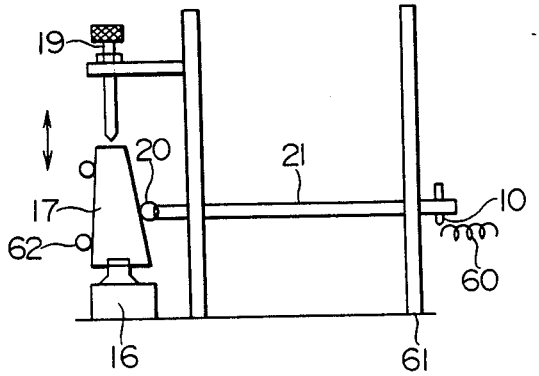
FIG. 2 is a partial side elevational view of the spring producing apparatus of FIG. 1.
Figure 3:
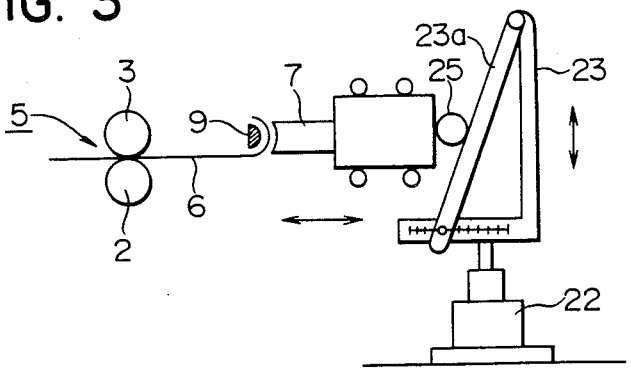
FIG. 3 is a partial front elevational view showing another part of the spring producing apparatus of FIG. 1.

Referring first to FIGS. 1 to 3, there is shown a spring producing apparatus of a preferred embodiment of the present invention. The spring producing apparatus 1 includes, as seen in FIG. 1, a pair of wire stock feeding rollers 5 consisting of a drive roller 2 and a follower roller 3 which is held in contact with the drive roller 2 so that the follower roller 3 may be driven by the the drive roller, a bending die 7 disposed in a predetermined spaced relationship from the pair of wire stock feeding rollers 5 in the direction in which a wire stock 6 is fed, a metal core 9 having a semicircular cross section and disposed forwardly of the die 7, and a pitch tool 10 and a cutter 11 disposed around the metal core 9.

A small gear 12 is secured to a shaft 2*a* of the drive roller 2 of the pair of wire stock feeding rollers 5 and is held in meshing engagement with an output gear 15 secured to an output power shaft 13*a* of a controlled speed motor 13 with a clutch brake. Accordingly, rotation of the motor 13 which is continuously rotating at a predetermined speed under an instruction from a controller not shown is transmitted to the drive roller 2 via the gears 15 and 12 and via the clutch brake which is engaged or disengaged at a suitable timing in response to an instruction from the controller. Consequently, the wire stock 6 forwarded from a reel or the like not shown is fed intermittently by a predetermined length at a predetermined speed to the deflecting face 7*a* of the bending die 7 so that it may be curved in a predetermined radius of curvature and wrapped into coils around the metal core 9 to form a spring.

Figure 9:
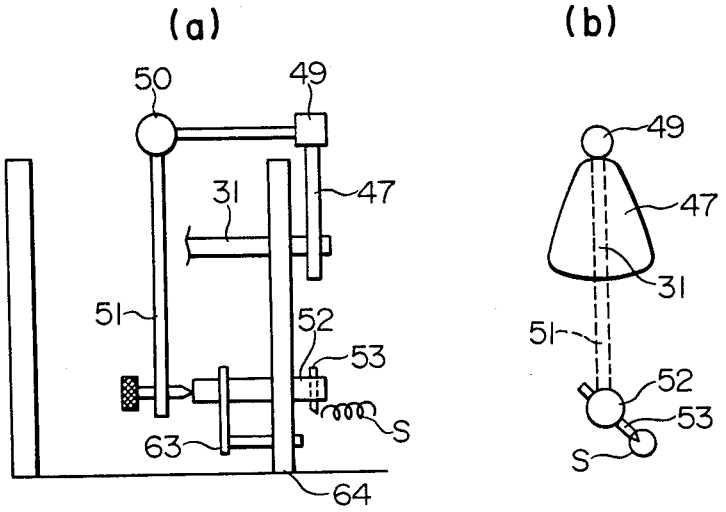
FIG. 9 PRIOR ART
FIG. 9 is a partial side elevational view of the spring producing apparatus of FIG. 8.
Figure 10:
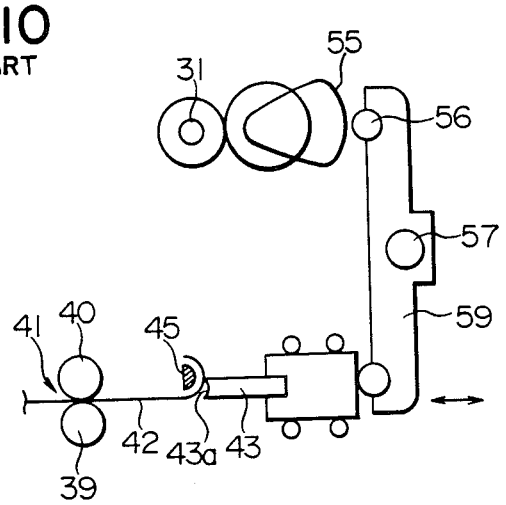
FIG. 10 PRIOR ART
FIG. 10 is a partial front elevational view of another part of the spring producing apparatus of FIG. 8.

In FIG. 2, reference numeral 60 denotes a coil spring, 61 a front plate, 62 a backup roller, while in FIG. 9, 63 is a detent and 64 another front plate.

Upon such shaping of the spring, if the pitch tool 10 is contacted with the wire stock 6 being curved by the bending die 7 so that it may apply a pressing force, for example, from below in FIG. 1 and also from leftwardly in FIG. 2, a predetermined pitch is provided to the spring to be shaped. Such provision of a pitch is attained in the following manner. In particular, referring to FIG. 2, an actuator 16 which provides a linear motion, such as, for example, an electromagnetic actuator or a hydraulic actuator, is controlled in accordance with instructions from the aforementioned controller so that a triangular cam 17 connected to the actuator 16 is either positioned to a predetermined position by a pitch adjusting bolt 19 which is adjustably turned by a stepping motor or a like means not shown, or, moved in a predetermined direction over a predetermined range in order, either to position the pitch tool 10 to a predetermined position via the cam follower 20 held in contact with the triangular cam 17 via a cam shaft 21 or to displace the pitch tool 10 in a suitable direction over a predetermined range.

Referring to FIG. 3, also upon shaping of the spring, the operation of another actuator 22 of a suitable type is controlled in accordance with an instruction from the aforementioned controller so that another triangular cam 23 which is designed such, that the inclination thereof may be changed, is either positioned to a predetermined position, or moved in a predetermined direction over a predetermined range, either to position the bending die 7 to a predetermined position, or, to move the bending die 7 in a predetermined direction over a predetermined range, via a cam follower 25 which is held in contact with a cam face 23*a* of the triangular cam 23 in order to provide a desired coil diameter configuration to a spring to be produced.

It is to be noted that the setting of the inclination of the cam face 23*a* of the triangle cam 23 is attained by a further actuator, not shown, provided, for example, on the triangle cam 23.

The aforementioned controller may be fabricated, for example, of a microcomputer and has stored therein various data and functions which associate the data with each other, so that various types of springs may be produced on the spring producing apparatus. Various manually operable knobs or like elements are disposed on an operation panel of the controller, and as the knobs are operated to individual setting graduations so as to input predetermined values or codes to the controller, various output signals corresponding to a spring to be produced are delivered to the motor 13 and the actuators 16 and 22.

Since the present embodiment has such a construction as described above, when the type of spring to be produced is to be changed, an operator will perform the desired setting operations by way of the various setting graduations on the operation panel of the controller.

Consequently, in response to the setting operations, the speed of rotation of the controlled speed motor 13 with the clutch brake is changed or the engaging and disengaging the timing of the clutch brake are changed, whereby the feed amount of the wire stock 6 by the pair of wire stock feeding rollers 5 is adjusted to determine the length of the spring to be produced.

At the same time, upon the termination of a single spring in connection with the engaging and disengaging timing of the clutch brake, the operation timing of the cutting actuator connected to the cutter 11 is determined.

Meanwhile, the positions or the extents of displacement of the various adjusting actuators 16, 22 etc. are changed, and in response to such changes, the position or the extent of displacement of the pitch tool 10 is changed via the triangular cam 23 while the position or the extent of displacement of the bending die 7 is changed via the triangular cam 23, so as to determine the pitch or the coil diameter configuration of a spring to be produced.

It is to be noted that while in the embodiment described above the actuators 16, 22 and so on for operating the triangular cams 17, 23 etc. are described as of the linear motion type, they may otherwise be of the pivotal motion type, and in the latter case, the profiles of the cams may be suitably changed Subsequently, the second invention of the present invention will be described with reference to FIGS. 4 to FIG. 7.

Figure 4:
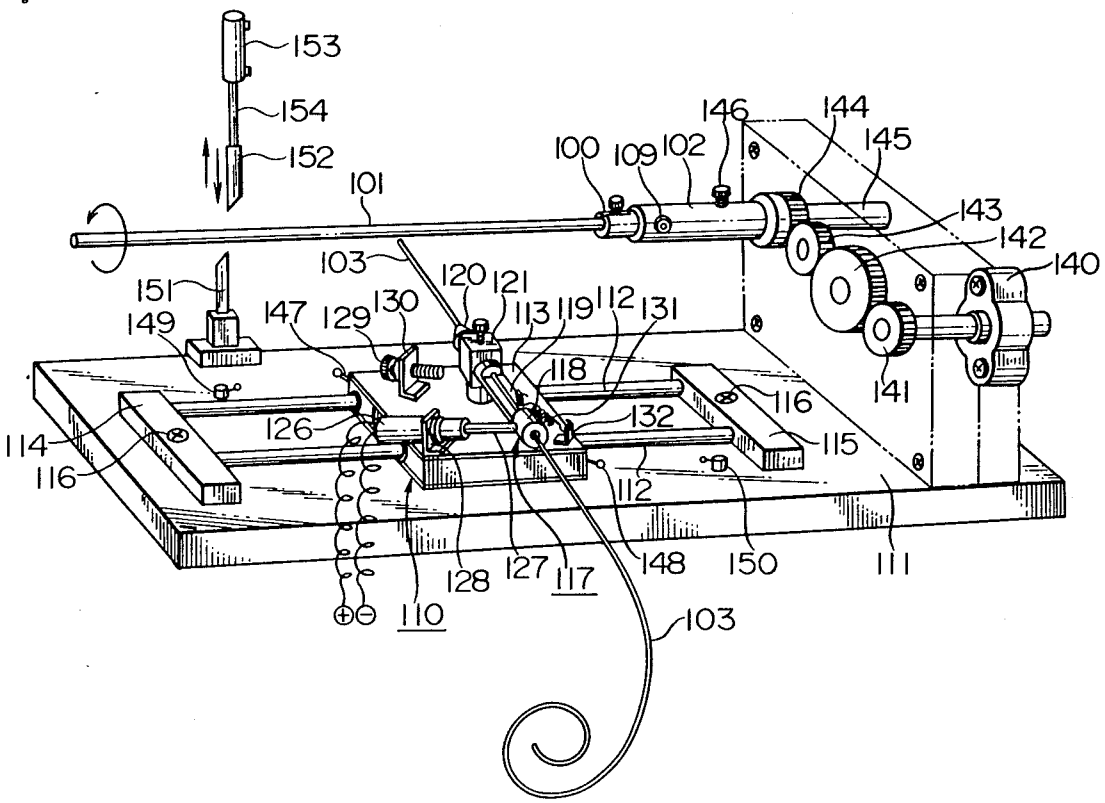
FIG. 4 is a perspective view of a spring producing apparatus according to a second feature of the present invention.
Figure 5:
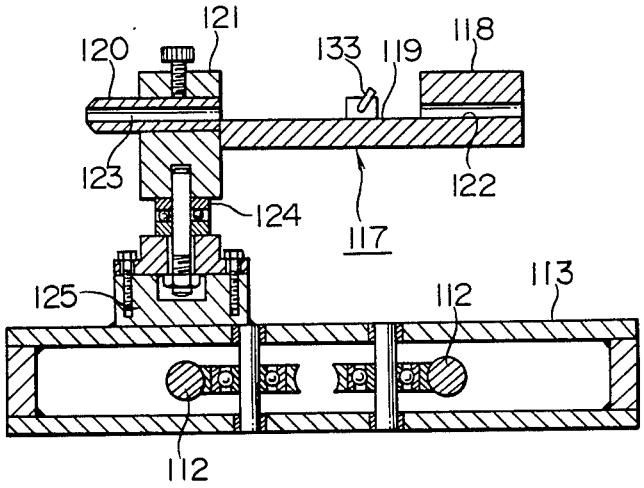
FIG. 5 is a sectional view of essential part of the spring producing apparatus of FIG. 4.

As shown in FIG. 4, the spring producing apparatus is constituted as an experimental spring producing apparatus wherein a wire stock is wrapped into coils around a metal core to experimentally produce a spring.

Reference numeral 100 denotes a chuck which has a through-hole formed therein in the direction of an axis thereof, and a metal core 101 is securely fitted in the through-hole 105. A connecting member 102 is mounted on the other outer periphery of the chuck 100 and securely fitted on a shaft.

Figure 6:
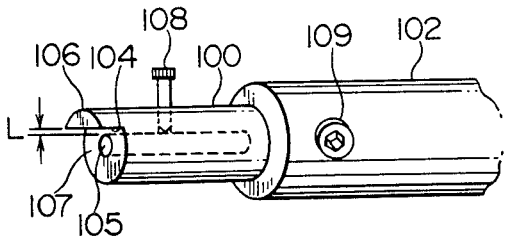
FIG. 6 is an enlarged perspective view of a chuck means of the spring producing apparatus of FIG. 4.

A stepped portion 104 is formed on an end face of the chuck 100 on the metal core 101 side for cooperating with the metal core 101 to fittedly hold the wire stock 103 as shown in FIG. 6, and a substantially semicircular projected portion 106 and a semicircular end face 107 having the through-hole 105 are formed by the stepped portion 104 while a wire stock arresting portion denoted at L is formed by an outer circumferential face of the metal core 101 securely fitted in the through-hole 105, that is, the diameter of the through-hole 105, and a lower face of the projected portion 106.

Reference numerals 108 and 109 each denotes a letting off preventing fastening member such as a screw or a bolt screwed into the chuck 100 or the connecting member 102, respectively.

Reference numeral 110 denotes a linear guide mounted on an upper face of a base 111, and table 113 is incorporated in the linear guide 110 and fitted for sliding movement by means of bearings not shown on a pair of guide rails 112 which extend in parallel to the metal core 101.

Reference numerals 114 and 115 each denotes a stopper for supporting the guide rails 112 thereon, and the stoppers 114 and 115 are mounted on the base 111 by means of fastening members 116.

A guide 117 serving also as a pitch tool is set substantially at the center of the table 113.

The pitch tool/guide member 117 is composed of a guide portion 118 for guiding the wire stock 103, a wire stock pressing portion 119, and a pitch tool portion 121 in which a nozzle 120 is incorporated.

A through-hole 122 is formed in the direction of an axis in the guide portion 118 while another through-hole 123 is formed in the direction of an axis in the nozzle 120. The through-holes 122 and 123 have a substantially same diameter with the wire stock 103 to form a coil spring, and a flat face of the pressing portion 119 located between the through-holes 122 and 123 lies substantially in the same horizontal plane with bottom walls of the through-holes 122 and 123.

The pitch tool portion 121 is mounted at a lower part thereof on the support member 125 by way of a sliding bearing or a ball bearing 124 so that it may be supported for pivotal motion relative to the table 113.

Reference numeral 126 denotes one of push-pull mechanisms, that is, an actuator such as, for example, a solenoid air cylinder or an oil cylinder which is mounted on the table 113 by means of a holder 128 for pivoting the pitch tool portion 121 to a predetermined angle. An end of a rod 127 for forward or rearward movement is secured to a side wall of the pitch tool portion 121 using a suitable means.

Reference numeral 129 denotes a pitch adjusting screw which is mounted adjacent the pitch tool portion 121 by means of a holder 130 so that the angle of inclination of the pitch tool portion 121, that is, the pitch of a coil spring, can be determined in advance.

Reference numeral 131 denotes a spring for returning the pitch tool/guide member 117, which has been pulled together with the rod 127 upon operation of the solenoid 126, to its initial position upon deenergization of the solenoid 126. One end of the spring 131 is secured to the guide portion 118 while the other end thereof is mounted on a holder 132 which is in turn mounted on the table 113.

The wire stock pressing portion 119 is a flat face formed between the guide portion 118 and the nozzle 120, and the wire stock 103 is pressed against the flat face by a suitable pressing member 133 so that the friction maybe increased to form the wire stock 103 into a spring of a predetermined pitch.

Reference numeral 140 denotes a motor with a clutch brake or a reversible controlled speed motor which can be rotated at a required speed, and power is transmitted from a shaft of the motor 140 via a transmission mechanism including first to fourth gears 141 to 144 and so on.

The connecting member 102 is fitted at one end of a shaft 145 which is rotated in an integral relationship with the fourth gear and is secured to the shaft 145 by a bolt 146.

Meanwhile, a one-way clutch not shown is interposed between the fourth gear 144 and the shaft 145 so that, when the wrapping of the wire stock 103 around the metal core 101 comes to an end, rotation is stopped and at the same time reverse rotation can be facilitated by the resilience of the coiled spring.

Reference numerals 147 and 148 denote each a limit switch which is mounted at an end of each of the opposite side walls of the table 113 of the linear guide while a pair of stoppers 149 and 150 corresponding to the switches 147 and 148, respectively, are provided on the base 111 side.

Reference numerals 151 and 152 denote lower and upper cutters for cutting the wire stock 103 from below and above, respectively, and the lower cutter 151 is mounted on the base 111 side while the upper cutter 152 is mounted at one end of an actuator 153 such as a hydraulic or pneumatic cylinder and is mounted at an end of a piston rod 154 which is moved up and down by a suitable known controlling device.

The present embodiment has the construction hereinbefore described, and manual operation to feed a wire stock and return the table upon starting will now be described.

Figure 7:
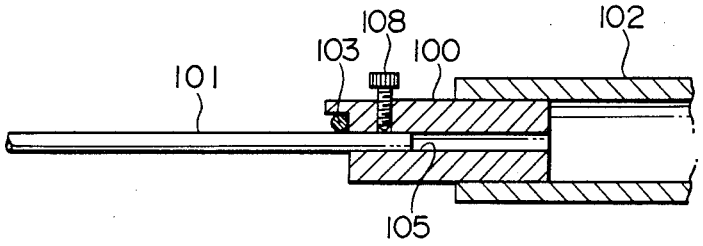
FIG. 7 is a sectional view showing a metal core mounted on the chuck means of FIG. 6.
Figure 8:
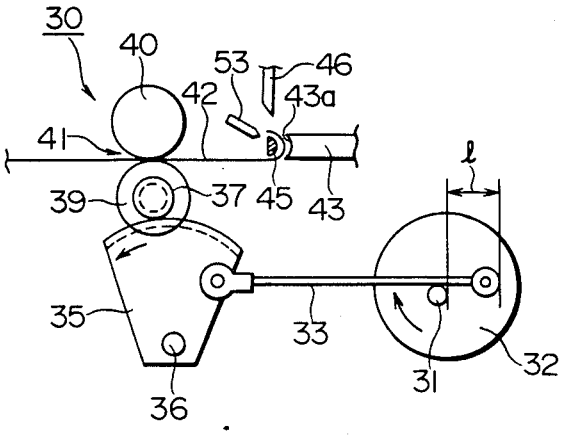
FIG. 8 PRIOR ART
FIG. 8 is a partial front elevational view of a conventional spring producing apparatus.

At first, it is confirmed that the diameter of the wire stock 103 is substantially the same as the width L (refer to FIG. 6) at the stepped portion 104 of the chuck 100, and then the wire stock 103 is inserted into the chuck 100 as seen in FIG. 7.

Then, the power switch is turned on. Consequently, the wire stock 103 is wrapped around the metal core 101 in a condition wherein it is held between the rotating metal core 101 and the chuck 100. The wire stock 103 thus follows rotation of the chuck and is wrapped around the metal core 101 with adjacent coils thereof closely contacted with each other. At the same time, the table 113 starts its movement along the guide rail 112, and after the wire stock 103 has been wrapped by a fixed number of turns or coils, the pitch tool/guide member 117 is pivoted by a required angle by operation of the solenoid 126 so that the pitch is developed at the coils of the wire stock 103. In this condition, a required number of coils is formed, and thereafter the power switch is turned off so that the solenoid is deenergized.

Upon deenergization of the solenoid, the pitch tool/-guide member 117 is returned to its initial position while the wire stock 103 is further wrapped around the metal core with the pitch of coils closed, and when the table limit switch is brought into contact with the corresponding stopper on the base, rotation of the metal core is stopped.

After stopping, the metal core is rotated a little in reverse to accommodate resilience.

In a synchronized relationship with stopping of the reverse rotation of the metal core, the actuator 153 like a piston rod is rendered operative to move down the upper cutter 152 to cut the wire stock 103 or else the wire stock 103 is cut by another tool.

A coil spring thus cut off the wire stock is then removed from the metal core.

Then, the table is manually returned to its initial position for starting, thereby completing the operation.

Thus, a compression spring is completed wherein a closely wound portion is formed at each of the opposite ends thereof and a required pitch is provided at a central portion thereof.

It is to be noted that, in case the wire stock is wound into coils in a close contact relationship at the start of the operation, a tension spring is produced.

A known automatic control mechanism can be incorporated into the apparatus of the present invention to make up semi-automatic spring coiling machine.

In particular, position sensors are provided adjacent the chuck and the table while the feeding of wire stock can be performed automatically with a controlled amount and with a pivoting angle of the pitch tool portion by means of known upper and lower feeding rollers and a microcomputer. For reciprocal motion of the table, a ball screw is incorporated and a shaft with the ball screw is coupled to a transmission mechanism on the side of the motor with a clutch brake.

With the construction described above, upon turning on of the switch, the motor and the feeding drive roller are rendered operative so that the chuck is stopped at a fixed position and at the same time the wire stock is chucked by the chuck.

After the wire stock has been chucked, the position sensors operate so that the wire stock convolutions are wrapped in a close contact relationship with each other and the table starts its forward movement as the metal core integral with the chuck is rotated. Then when the table reaches a predetermined location, the solenoid is rendered operative so that the pitch tool portion is pivoted to a required angle.

By the pivotal motion of the pitch tool portion, a pitch is formed on the wire stock being wrapped, and then when the switch is turned off, the solenoid is deenergized.

Then, the pitch tool portion is returned to its initial position in which it extends in a direction perpendicular to the metal core, and at the same time the wire stock is convoluted into coils in a close contact relationship with each other, and via limit switches provided on the table and so on, rotation of the ball screw, feeding of the wire stock and rotation of the metal core are stopped.

Subsequently, by operation of the microcomputer, the upper cutter mounted at the end of the piston rod is moved down to cut the wire stock.

In a synchronized relationship with a subsequent upward movement of the upper cutter, turning of the ball screw is reversed so that the table is returned to its initial position.

Meanwhile, the coil spring is removed from the metal core by means of an attachment mounted on the base.

What is claimed is:

1. A spring producing apparatus, comprising in combination:

(a) vertical and horizontal support means, including a base (111);

(b) a chuck (100), having a forward end and a rear section, with a connecting member (102) at said rear section holding said chuck to the vertical support means, including transmission means for connecting said connecting member to a reversible motor with a clutch brake, also, said chuck (100) having an end face at said forward end with a stepped portion (104);

(c) an elongated cylindrical metal core (101) with a rear end which is removably and fittably mounted on said chuck forward end and held against free rotational motion by fastening means so as to be turned by the chuck;

(d) a pair of horizontal guide rails (112) mounted on said base (111) parallel to said metal core (101);

(e) a table (113) mounted on said guide rails including a linear guide (110) on said table, said table and linear guide (110) being adapted for motion parallel to said metal core (101);

(f) wire stock feed means, including a wire guide and pitch tool (117) on said table (113) including a tubular guide portion (118), a wire stock pressing portion (119), a pitch tool portion (121) incorporating a nozzle (120) for feeding wire stock (103) onto said metal core (101);

(g) an actuator (126) disposed on said linear guide (110) for movement together with the wire guide and pitch tool (117), so as to apply a predetermined pitch to the coils of the spring; and, (h) a cutter (152) moved up and down by the operation of a cutting actuator (153) disposed for cutting the wire stock.

* * * * *